US009862104B2

(12) United States Patent
France

(10) Patent No.: US 9,862,104 B2
(45) Date of Patent: Jan. 9, 2018

(54) FOLDING KNIFE WITH DUAL OPERATIONAL MODES

(71) Applicant: Benchmade Knife Co., Inc., Oregon City, OR (US)

(72) Inventor: Jason France, Oregon City, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 104 days.

(21) Appl. No.: 14/759,216

(22) PCT Filed: Feb. 13, 2014

(86) PCT No.: PCT/US2014/016186
§ 371 (c)(1),
(2) Date: Jul. 3, 2015

(87) PCT Pub. No.: WO2014/130333
PCT Pub. Date: Aug. 28, 2014

(65) Prior Publication Data

US 2015/0352731 A1 Dec. 10, 2015

Related U.S. Application Data

(60) Provisional application No. 61/766,770, filed on Feb. 20, 2013.

(51) Int. Cl.
*B26B 1/04* (2006.01)

(52) U.S. Cl.
CPC ..... *B26B 1/048* (2013.01)

(58) Field of Classification Search
CPC ..... B26B 1/02; B26B 1/042; B26B 1/048
(Continued)

(56) References Cited

U.S. PATENT DOCUMENTS 2,741,841 A 4/1956 Egeth
3,834,022 A 9/1974 Students
(Continued)

FOREIGN PATENT DOCUMENTS

FR 2580537 A1 * 10/1986 ..... B26B 1/02
FR 2793182 11/2000
(Continued)

OTHER PUBLICATIONS

Extended European Search Report; European Patent Application No. 14753763.3, dated Sep. 19, 2016, which is a copending European Application that claims priority from PCT/US2014/016186.

*Primary Examiner* — Jason Daniel Prone
(74) *Attorney, Agent, or Firm* — Schwabe Williamson & Wyatt, P.C.

(57) ABSTRACT

A folding knife has mechanisms for facilitating dual operational modes for opening the blade. In a first modality, the knife is opened and closed manually. In a second modality, the knife is fully automatic. When the blade is in the closed position the user may use either mode, manual or automatic, without any switching mechanism. A lock securely locks the blade in the open position when either opening modality is being used. To open the blade manually, the user rotates the blade from the closed to the open position—the lock automatically locks the blade open when the blade is fully open. To open the blade automatically, the lock mechanism functions as the trigger mechanism; the user slides the lock mechanism to actuate the automatic open mechanism. When the blade is in the fully open position the lock secures the blade open. A torsion spring around the pivot shaft that connects the blade to the handle and which is retained in a bushing drives the blade open in the automatic mode. The knife includes a "dry fire safety" mechanism that prevents operation of the automatic opening mechanisms when the
(Continued)

blade is in the open position or in any position intermediate between open and closed when the manual modality is used.

12 Claims, 13 Drawing Sheets

(58) Field of Classification Search
USPC ..... 30/153, 155–161
See application file for complete search history.

(56) References Cited

U.S. PATENT DOCUMENTS 4,535,539 A * 8/1985 Friedman ..... B26B 1/046 30/159
4,811,486 A * 3/1989 Cunningham ..... B26B 1/048 30/151
4,974,323 A 12/1990 Cassady
5,029,414 A 7/1991 Boyd, Jr. et al.
5,044,079 A 9/1991 Gibbs
5,647,129 A 7/1997 Stamper
5,819,414 A 10/1998 Marifone
5,915,792 A 6/1999 Sakurai
5,964,035 A 10/1999 Poehlmann
6,308,420 B1 10/2001 Moser
6,363,615 B1 4/2002 Moser
6,574,869 B1 6/2003 McHenry et al.
6,618,946 B2 9/2003 Seraphin
6,651,344 B2 11/2003 Cheng
6,675,484 B2 1/2004 McHenry et al.
6,732,436 B2 5/2004 Moizis
6,941,661 B2 9/2005 Frazer
6,951,055 B1 10/2005 Collins
7,086,157 B2 8/2006 Vallotton
7,107,686 B2 9/2006 Linn et al.
7,243,430 B1 7/2007 Lerch
7,278,213 B2 10/2007 Perdue et al.
7,293,360 B2 11/2007 Steigerwalt et al.
7,296,355 B2 11/2007 Onion
7,313,866 B2 1/2008 Linn et al.
7,325,312 B1 2/2008 Janich
7,380,340 B1 6/2008 Lerch
7,437,822 B2 10/2008 Flagg et al.
7,562,454 B2 * 7/2009 Steigerwalt ..... B26B 1/02 30/159
7,603,778 B1 10/2009 Lerch
7,627,951 B2 12/2009 Glesser
7,676,931 B2 3/2010 Knight et al.
RE41,259 E 4/2010 McHenry et al.
7,698,821 B2 4/2010 Ralph
7,748,122 B2 7/2010 Duey
7,886,444 B2 * 2/2011 Kao ..... B26B 1/044 30/159
7,918,028 B2 4/2011 Steigerwalt et al.
D639,632 S 6/2011 Freeman et al.
8,020,302 B2 * 9/2011 Kao ..... B26B 1/02 30/155
8,046,923 B2 11/2011 Liu
8,171,645 B2 5/2012 Duey
8,286,356 B1 * 10/2012 Mollick ..... B26B 1/042 30/155
8,291,597 B2 * 10/2012 Hawk ..... B26B 1/048 30/155
8,375,590 B2 2/2013 Duey
8,458,913 B2 * 6/2013 Lo ..... B26B 1/02 30/159
8,490,288 B1 * 7/2013 Mollick ..... B26B 1/046 30/155
8,499,460 B1 * 8/2013 Pearman ..... B26B 1/044 30/155
8,978,253 B2 * 3/2015 Snyder ..... B26B 1/02 30/155
9,227,330 B2 * 1/2016 Fellows ..... B26B 1/048 30/161
9,346,176 B2 * 5/2016 Collins ..... B26B 1/048 30/159
9,505,141 B2 * 11/2016 Duey ..... B26B 1/046 30/159
9,527,218 B2 * 12/2016 Valdez ..... B26B 1/044 30/159
2002/0124415 A1 9/2002 Mizutani et al.
2003/0140500 A1 7/2003 Cheng
2004/0154170 A1 8/2004 Kain et al.
2004/0158891 A1 8/2004 Freeman
2004/0261272 A1 12/2004 Moser
2005/0194238 A1 * 9/2005 Frazer ..... B26B 1/048 200/48 A
2005/0223562 A1 10/2005 Pardue et al.
2005/0262701 A1 12/2005 Lai
2006/0059694 A1 3/2006 Carter
2006/0064877 A1 3/2006 Vallotton
2006/0288585 A1 * 12/2006 Kao ..... B26B 1/02 30/159
2007/0137047 A1 6/2007 Kim
2007/0169354 A1 7/2007 Ralph
2007/0180702 A1 8/2007 Haw et al.
2008/0201953 A1 8/2008 Bremer et al.
2008/0301949 A1 12/2008 Enga et al.
2009/0056146 A1 3/2009 Duey
2009/0119926 A1 5/2009 Nenadic
2009/0144986 A1 * 6/2009 Frazer ..... B26B 1/048 30/159
2009/0265939 A1 10/2009 Chu
2009/0277015 A1 11/2009 Duey
2009/0288301 A1 11/2009 Hawk et al.
2010/0140059 A1 6/2010 Kagami et al.
2011/0099817 A1 5/2011 Duey
2011/0162211 A1 7/2011 Maxey
2011/0167647 A1 7/2011 Gringer et al.
2012/0047746 A1 3/2012 Caswell
2013/0145598 A1 * 6/2013 Duey ..... B26B 1/048 29/434
2013/0263455 A1 * 10/2013 Collins ..... B26B 1/044 30/159
2014/0259687 A1 * 9/2014 Griffey ..... B26B 1/044 30/159
2015/0352730 A1 * 12/2015 Duey ..... B26B 1/048 30/159

FOREIGN PATENT DOCUMENTS

FR 2793182 A3 * 11/2000 ..... B26B 1/02
WO WO 2009032043 A1 * 3/2009 ..... B26B 1/048
WO WO 2012096748 A1 * 7/2012 ..... B26B 1/048
WO WO 2014039255 A1 * 3/2014 ..... B26B 1/044
WO WO 2014130333 A1 * 8/2014 ..... B26B 1/048
WO WO 2014130905 A2 * 8/2014 ..... B26B 1/048

* cited by examiner

FOLDING KNIFE WITH DUAL OPERATIONAL MODES

CROSS-REFERENCE TO RELATED APPLICATIONS

This application is a National Stage Entry of International Patent Application No. PCT/US14/16186, filed Feb. 13, 2014, which claims the priority benefit of U.S. Provisional Application No. 61/766,770, filed Feb. 20, 2013.

TECHNICAL FIELD

The present invention relates to knives, and more particularly, to a folding knife that is capable of operating in dual operational modes, the first being a manual mode in which the blade is movable from the stowed or closed position to the open position, and vice versa, by manual manipulation, and the second being an automatic mode in which the blade is driven from the closed position to the open position automatically under spring force. The knife includes a locking mechanism that allows the blade to be locked in the open position—the lock bar functions as the trigger for firing the knife in the automatic opening mode. The knife further includes a safety mechanism that ensures that the operator cannot actuate the automatic opening mode when the knife blade is in the open position or intermediate between open and closed positions.

BACKGROUND INFORMATION

Folding knives are invaluable tools that are used in many aspects of everyday life, and there are many, many types and styles of folding knives. A "manual" folding knife is a very traditional type of tool in which the blade is manually movable by the user between a closed or stowed position in which the sharp edge of the blade is held safely within the handle, and an open position in which the blade is extended in an operable position. There are innumerable variations on this basic theme.

Automatic folding knifes are nearly as ubiquitous as manual folders. These knives include some type of a mechanism—almost always a spring-driven mechanism—that drives the blade from the closed position toward the open position when the user activates the automatic mechanism, typically by pushing a button or analogous activating mechanism. Generally speaking, in a knife that has an automatic opening mechanism the blade is held in the closed position by a latched trigger mechanism. When closed, the blade is under a constant "pre-load" pressure from a spring mechanism. When the trigger is released, the blade is automatically driven by the spring mechanism into the open position.

Most folding knives, whether manual or automatic, incorporate some kind of a mechanism that holds the blade or working implement in the closed position in which the sharp edge of the blade is held safely within the handle. There are many known mechanisms for retaining blades in the closed position, and there are obvious reasons why such mechanisms are used. Among other reasons, blade-retaining mechanisms prevent unintended opening of the knife and thus promote safety. Many folders also include mechanisms that lock the blade in the open position, primarily as a safety feature. There are many different types of these locks.

Manual and automatic knives have many uses and can be used in many different settings, and that has led to a demand expressed by many knife users for knives that are operable in dual modes, both automatic and manual. There are benefits to be had in knives that have dual modes of operation and there are a few known dual mode knives. For instance, dual mode knives are described in U.S. Pat. Nos. 7,603,778 and 8,046,923; both of those knives require switching mechanisms. Nonetheless, there is a continuing need for improved mechanisms for enabling dual operational modes in a folding knife, manual and automatic.

The present invention comprises a folding knife having mechanisms for facilitating dual operational modes. In a first modality, the knife is opened and closed manually. In a second modality, the knife is fully automatic. A lock mechanism securely locks the blade in the open position when either opening modality is being used. When the blade is in the closed position, the knife may be opened either manually or automatically. To open the blade manually, the user simply rotates the blade from the closed to the open position—the lock automatically locks the blade open when the blade is fully open. To open the blade automatically, the lock mechanism functions as the trigger mechanism; the user slides the lock mechanism to actuate the automatic open mechanism. Again, when the blade is in the fully open position the lock secures the blade open.

The knife utilizes a torsion spring around the pivot shaft that connects the blade to the handle and which is retained in a bushing. The spring drives the blade open in the automatic operational. One end of the spring rests against a wall of a pocket formed in the blade and extends through a slot in the bushing. The other end of the spring is fixed to the handle of the knife. When the blade is opened automatically, the spring and bushing rotate to drive the blade open; closing the blade rewinds the spring.

The knife includes a "dry fire safety" mechanism that prevents operation of the automatic opening mechanisms when the blade is in the open position or in any position intermediate between open and closed.

BRIEF DESCRIPTION OF THE DRAWINGS

The invention will be better understood and its numerous objects and advantages will be apparent by reference to the following derailed description of the invention when taken in conjunction with the following drawings.

FIG. 4 is a side elevation view of the knife shown in FIG. 3 (with the blade in the closed position) with the near side components of the handle removed to expose the internal structural components.

FIG. 5 is a side elevation view similar to FIG. 4 but showing the mechanisms in a different operational position from those shown in FIG. 4.

FIG. 6 is a side elevation view of the knife shown in FIG. 3 in which the components of the actuator mechanism are removed to illustrate the interaction of other components in the knife. In FIG. 6 the knife is ready to be fired open in the automatic mode or opened in the manual mode.

FIG. 7 is a side elevation view of the knife shown in FIG. 6 but in which the blade has been moved to an intermediate position between the closed and opened positions. In FIG. 7 the knife is being fired open automatically.

FIG. 8 is another side elevation view of the knife according to the present invention with the near side components removed; in this figure the blade is in the open and locked position, having been opened in the automatic opening modality.

FIG. 9 is a side elevation view similar to FIG. 8 except the blade has been unlocked and is being rotated from the open position toward the closed position.

FIG. 10 is a side elevation view similar to FIG. 9 except the blade has been rotated from the open position toward the closed position to a point where the blade is approaching the fully closed position.

FIG. 11 is a side elevation view similar to FIG. 9 illustrating the blade where it has been fully rotated to the closed position.

FIG. 12A is a side elevation view in which selected near side handle components are removed and the blade is in the closed position.

FIG. 12B is a side elevation view similar to FIG. 12A but in which the blade is being manually rotated from the closed position toward the open position.

FIG. 12C is a side elevation view of the knife in FIGS. 12A and 12B in which the blade is in the fully open and locked position.

FIGS. 13 through 16 illustrate a dry fire safety mechanism incorporated into the knife of the present invention. Specifically:

FIG. 13 is a side elevation view of one side of the knife in which select side wall components are removed to expose the dry fire safety mechanism. In FIG. 13 the blade is in the open position.

FIG. 14 is a side elevation view of the opposite side of the knife shown in FIG. 13, with select side wall components removed.

DETAILED DESCRIPTION OF THE INVENTION

Figures 1, 1A, 1B:
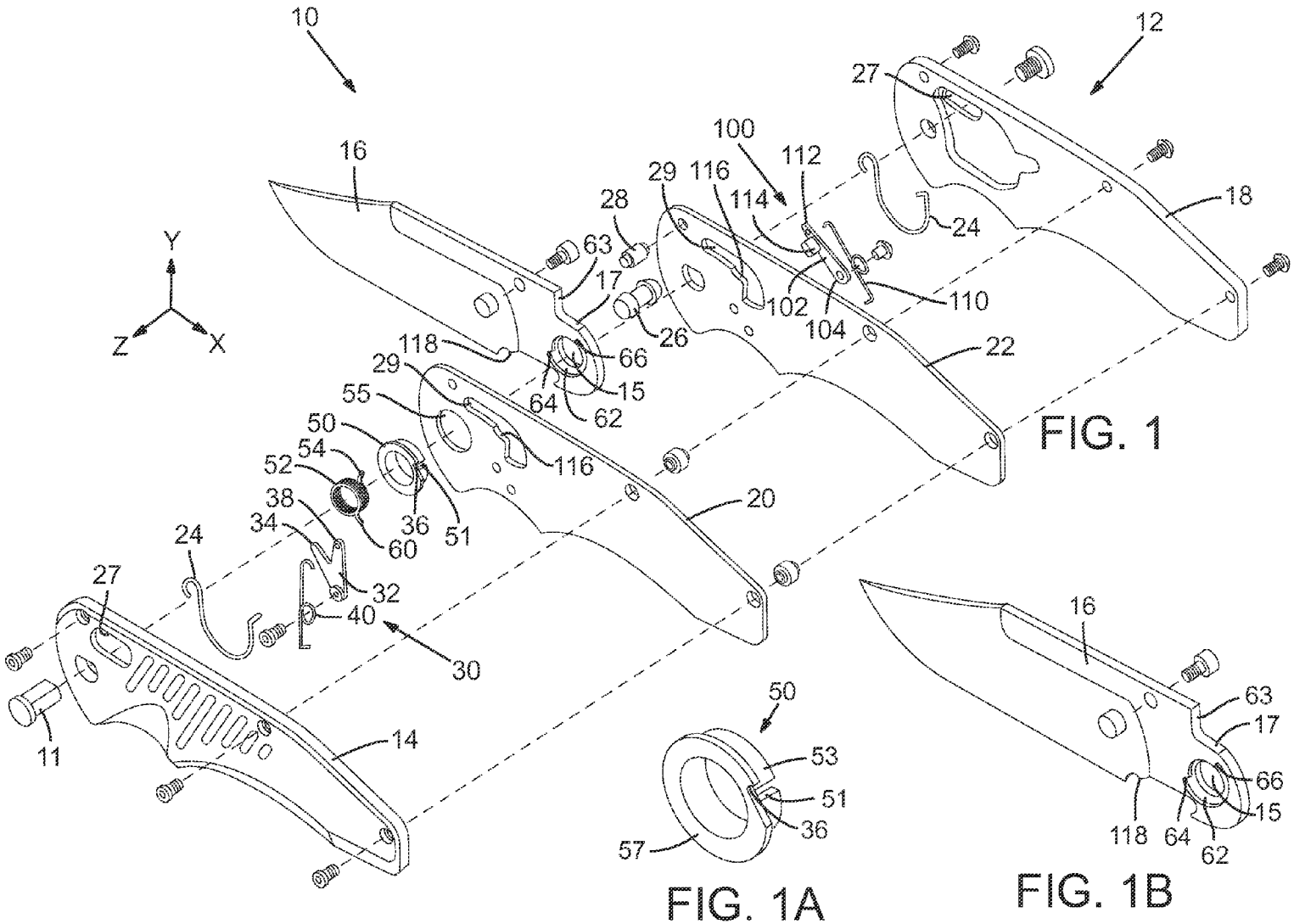
FIG. 1 is a perspective and exploded view of a first illustrated embodiment of a knife incorporating dual operational modes according to the present invention.
FIG. 1A is a perspective view of a bushing used in the knife according to the invention, shown in isolation.
FIG. 1B is a perspective and exploded view of the blade used in the knife according to the invention, shown in isolation.

With reference now to the drawings, a first illustrated embodiment of a folding knife 10 incorporating dual modality opening mechanisms according to the present invention is illustrated in FIGS. 1 through 16. Folding knife 10 includes an elongate handle 12 that is defined by a first sidewall 14 and an associated liner 20 and a second sidewall 18 with its associated liner 22. A blade 16 is pivotally attached to the handle between the sidewalls at one of its ends—referred to herein as the "forward" end of the handle—and is pivotally movable about blade pivot pin 11 between the open and closed positions along a blade plane. Other relative directional terms correspond to this convention: the "rear" or butt end of the handle is opposite the forward end; the "upper" part of the blade is the dull, non-working portion and the "lower" part of the blade is the sharpened, working portion; "inner" or "inward" refers to the structural center of the knife, and so on. An X-Y-Z axis grid is shown in FIG. 1. The X-Y plane is defined as the plane parallel to the plane defined by the handle 12 and blade 16—the blade travels in the X-Y plane as it is rotated between the closed and open positions. The Z plane is the plane transverse to the X-Y—the blade pivot pin extends longitudinally in the Z-plane.

The knife shown in the drawings includes some mechanical structures that are similar to those described in U.S. Reissue Pat. No. RE 41259, both in form and function, the disclosure of which is incorporated herein by this reference. More specifically, the locking mechanism and many of the basic structural features utilized in the knife described herein are similar to those described in U.S. Pat. No. RE 41259.

The knife according to the present invention is operable in dual modes. Specifically, the blade may be moved from the closed position to the open position by manual manipulation by the user. At the choice of the user, the blade may alternately be automatically moved from the closed to the open position. However, the user is not required to pre-select which operational mode to use to open the knife; with the blade in the closed position, the knife may be opened both manually and automatically without choosing any "switch" and without "switching" between the two modes with any type of affirmative selection of a mode.

The knife 10 according to the present invention is shown in perspective exploded view in FIG. 1. The basic structural components of knife 10 include those described above, and as shown in FIG. 1, a lock bar 26 that extends transverse to the plane of the handle and which has its opposite ends extending in slots 27 in side ails 14 and 18, which align operationally with paired slots 29 in liners 20 and 22. The lock bar 26 is spring loaded with two U or horseshoe-shaped lock springs 24, one such spring associated with each sidewall and positioned between the sidewall and the associated, adjacent liner. A first end of each lock spring 24 is fixed to the associated liner and the second end of the lock spring is attached to the lock bar 26 so that the lock bar is always driven in the "forward" direction by the springs—that is, in the direction from the handle 12 toward the tip of the blade 16 when the blade is open. The lock bar 26 and the springs that act on the lock bar define a locking mechanism that locks the blade 16 in the open position, as detailed in U.S. Pat. No. RE 41259. When the blade is fully open, the lock bar 26 is driven forward and interacts with a ramped portion 17 of blade 16 to lock the blade open. A blade stop pin 28 stops rotation of blade 16 in the open position, at which a shoulder 63 on the blade abuts the stop pin 28.

As detailed below, knife 10 incorporates an actuator mechanism shown generally at 30, a bushing 50 and a dry fire safety mechanism shown generally at 100.

Figure 2:
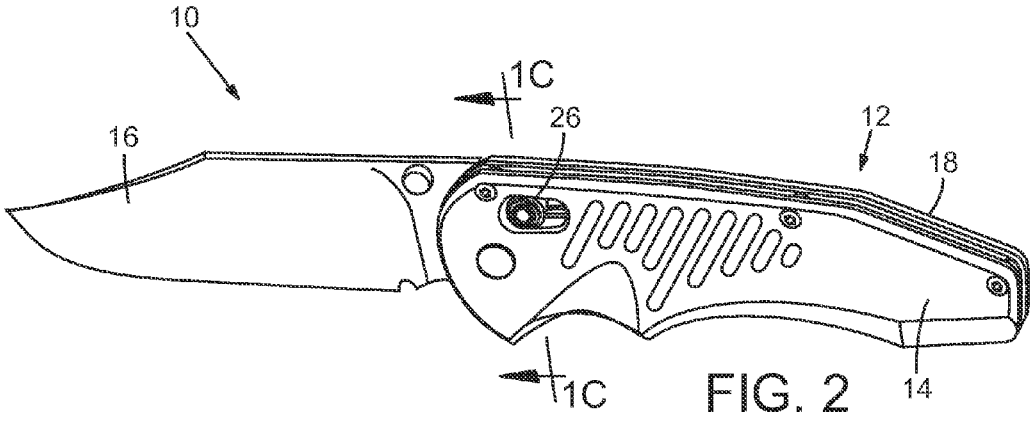
FIG. 2 is a perspective view of the knife shown in FIG. 1 in an assembled condition with the blade in the open, extended position and locked in that position.
Figure 3:
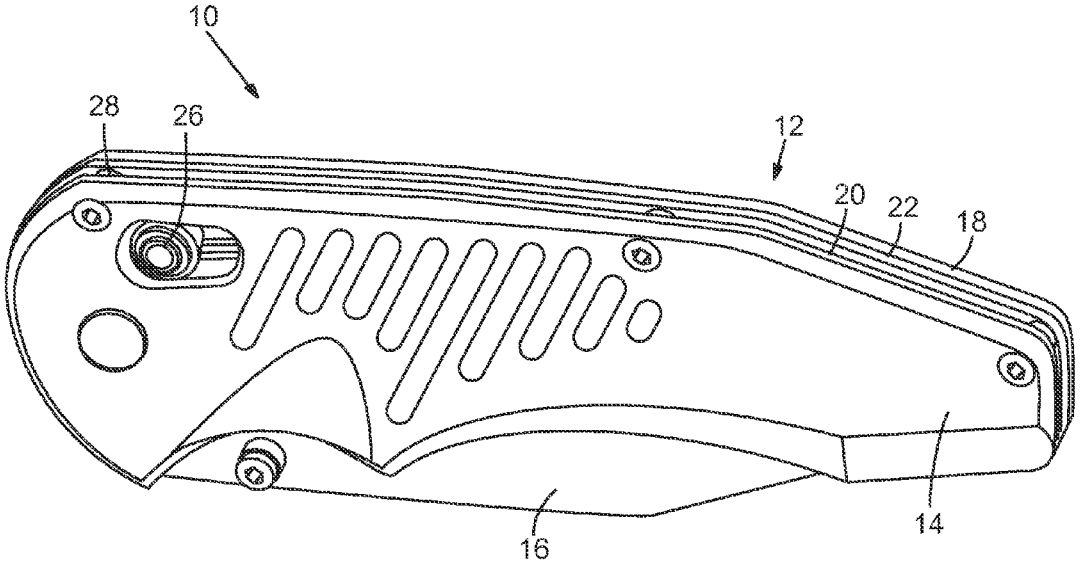
FIG. 3 is a perspective view of the knife shown in FIG. 2 with the blade in the folded, stowed position.

The knife 10 is shown fully assembled in FIGS. 2 and 3; in FIG. 2 the blade is in the open and locked position and in FIG. 3 the blade is in the closed position.

The structural components that define and facilitate the automatic opening modality of knife 10 are detailed with respect to the series of FIGS. 4 through 11, and with returning reference to FIGS. 1, 1A and 1B.

Figure 1C:
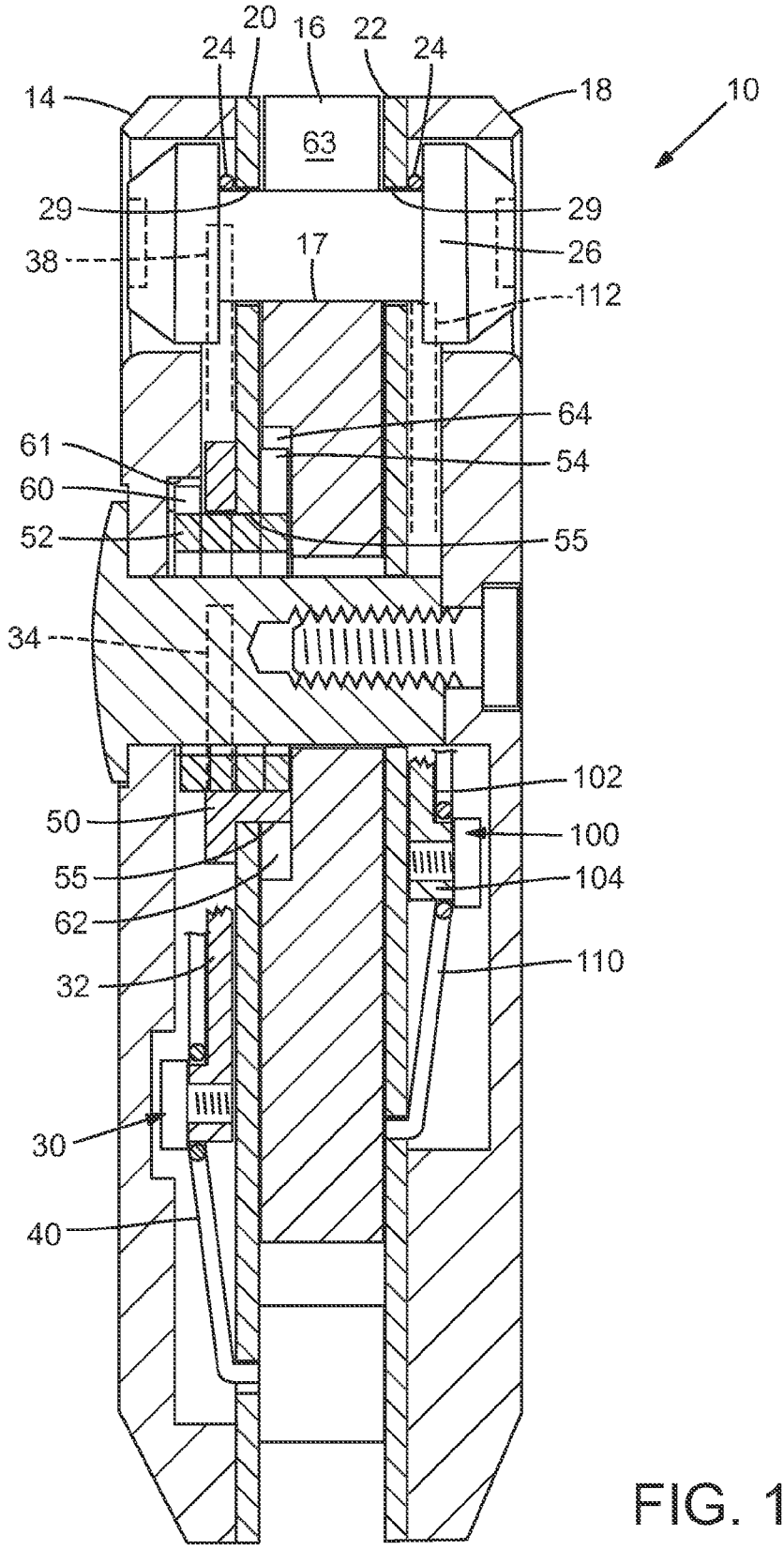
FIG. 1C is a cross sectional view of the knife according to the present invention taken along the line 1C-1C of FIG. 2, and showing the blade in the open and locked position.

A torsion spring 52 is housed in the bushing 50 with a first leg 60 of the spring being fixed relative to sidewall 14 (the near sidewall that is removed and not visible in FIG. 4) and the second leg of the spring, leg 54, extending through a slot 51 in the bushing 50 and resting in an arcuate pocket 62 formed in the blade 16 around the pivot shaft bore 15 in the blade. When the components illustrated in FIG. 1 are assembled together, as best illustrated in FIG. 1C, the inner cylindrical extension 53 of bushing 50 is inserted through a cooperatively sized opening 55 in liner 20 while the larger diameter cylindrical lip 57 rests against the outer surface of the liner. A notch 36 is formed in cylindrical lip 57. The first leg 60 of spring 52 is fixed to sidewall 14 in a notch 61 (visible in FIG. 1C) so that the first leg 60 is unmovable. The second leg 54 extends through slot 51 and into the arcuate pocket 62, one end of which is identified with reference number 64 and the opposite end of which is labeled with reference number 66. As detailed below, when the knife is fired from closed to open automatically, the torsion spring 52 unwinds and second leg 54 pushes against end 64 of pocket 62 to drive the blade open, while at the same time the spring 52 causes bushing 50 to simultaneously rotate because the second leg 54 also pushes on the side of slot 51. On the other hand, when the blade has been opened in the automatic mode and is then moved from open to closed, second leg 54 is pushed by end 64 to rewind torsion spring 52 as the blade is rotated to the closed position.

Figure 4:
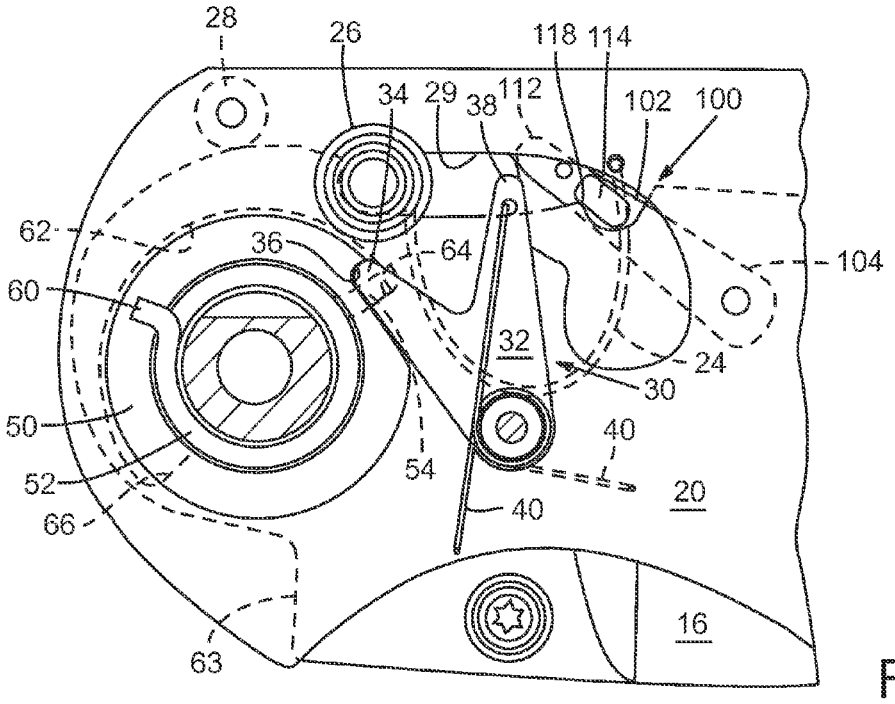
FIGS. 4 through 11 are a sequential series of illustrations showing operation of the knife in the automatic opening mode. Specifically.

Turning to FIG. 4, the actuator mechanism 30 includes a generally V-shaped (or U-shaped) actuator arm 32 that is pivotally fixed to liner 20 near the apex of the V shaped arm. The first arm 34 of the actuator arm 32 is positioned to interact with the notch 36 formed in the edge of the lip 57 of bushing 50, and the second arm 38 of the actuator arm 32 is attached to one end of a torsion spring 40 that biases the V-shaped actuator 32 toward the bushing 50 (i.e., counter-clockwise in the view of FIG. 4). The second end of spring 40 is attached to liner 20 and is shown in alternate positions in FIG. 4 (one with a solid line, one with a dashed line). The remainder of the drawings omit the alternate position (dashed line) but it will be understood that while either position will suffice, the alternate position (dashed line) may be used as the normal operating position for the spring 40 in the assembled knife.

With the first arm 34 engaged in notch 36 of the bushing 50 the bushing is locked up and cannot be rotated in the clockwise direction even though the torsion spring 52 is pushing against blade 16 and bushing 50. That is, as detailed above the second leg 54 of spring 52 is biased against end 64 of pocket 62 and also against slot 51 in bushing 50. However, the first arm 34 is engaged in notch 36 which prevents the spring 52 from unwinding. On the other hand, when the actuator arm 34 is disengaged from the notch 36, the bushing 50 is rotatable in the clockwise direction by the action of spring 52 unwinding and pushing against end 64 and slot 51 as it unwinds. Even when the blade is in the fully opened and locked position the spring 52 is biasing the blade toward the open position, although the stop pin 28 prevents further rotation of the blade. As noted, when the blade is open and has been opened automatically, when the blade is unlocked and rotated in the counterclockwise direction in FIG. 4 from open to closed, the spring 52 is rewound. The torsion spring 40 has its first end fixed to the liner 20 and its second end attached to the second arm 38—the spring is wound around the pivot axis that attaches the V-shaped actuator 32 to the liner. It will be appreciated that the actuator 32 is at all times urged in the counterclockwise direction in FIG. 4, under the spring forces of spring 40, such that the arm 34 is always biased toward the position where the arm engages notch 36.

Figure 5:
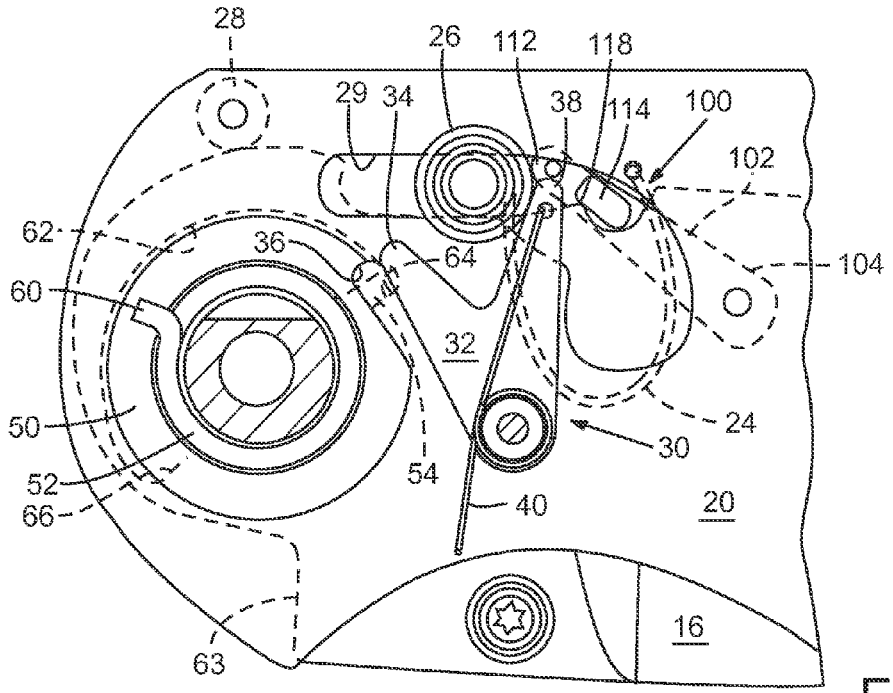

With reference to FIG. 5, the lock bar 26 is the trigger mechanism that actuates the automatic opening mechanism. When the lock bar 26 is moved rearwardly toward the butt or rear of the handle, the lock bar pushes against the second arm 38 of the V-shaped actuator 32, causing the actuator 32 to rotate clockwise about its pivotal connection (and against the spring force from spring 40) and thus causes first arm 34 to disengage from notch 36. With the arm 34 disengaged from notch 36, as shown in FIG. 5, the torsion spring 52 is free to "unwind" and bushing 50 is free to rotate in the clockwise direction as the second leg 54 pushes on the closed end of the slot through which the leg extends in bushing 50. This causes the blade 16 to rotate rapidly and automatically from the closed to the open position. The blade's rotation stops when shoulder 63 hits blade stop pin 28. In this position, lock bar 26 is released and is driven forward by the horseshoe-shaped springs 24 into the locking position to lock blade 16 open.

Figure 6:
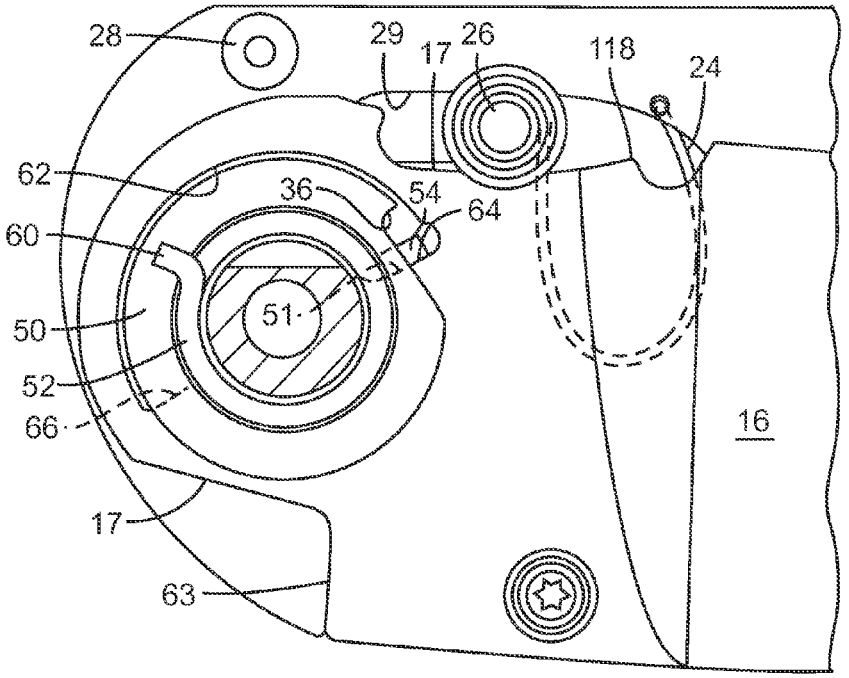

In FIG. 6 the components of actuator mechanism 30 and liner 20 are removed to illustrate the interaction of the various components of the actuator mechanism, including legs of torsion spring 52 with bushing 50 and blade 16.

As noted, the torsion spring 52 is housed in the interior of bushing 50 with a first leg 60 of the spring being fixed in a slot 61 in the near-side sidewall 14 (shown in FIG. 10) and the second leg of the spring, leg 54, resting in the arcuate pocket 62 formed in the blade 16. The second spring leg 54 is able to rotate only when bushing 50 can rotate. As the spring begins to unwind it exerts a clockwise moment on the blade, which causes it to begin to open.

Figure 7:
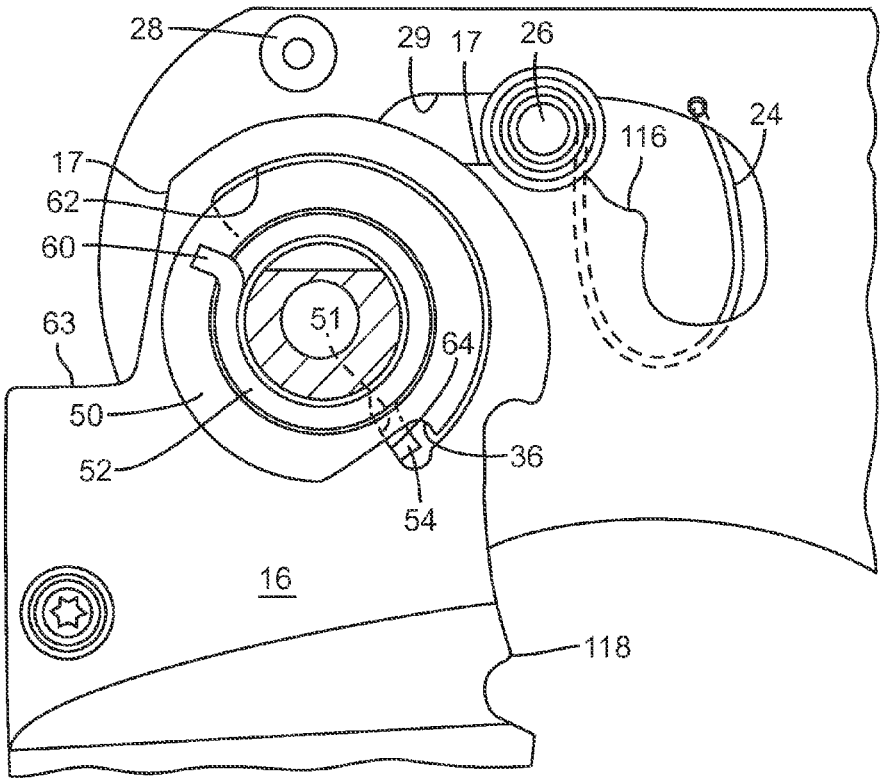

FIG. 7 shows the blade 16 in an intermediate position, about 90 degrees out of the closed position, as it moves from the fully closed toward the fully open position under the force of torsion spring 52 as the spring unwinds in the automatic opening mode. As spring 52 unwinds, the second leg 54 pushes against the end 64 of pocket 62 to apply a driving spring force against the blade 16. Again, first leg 60 is fixed to the near-side sidewall at slot 61, which in FIG. 7 is removed to illustrate the internal components.

Figure 8:
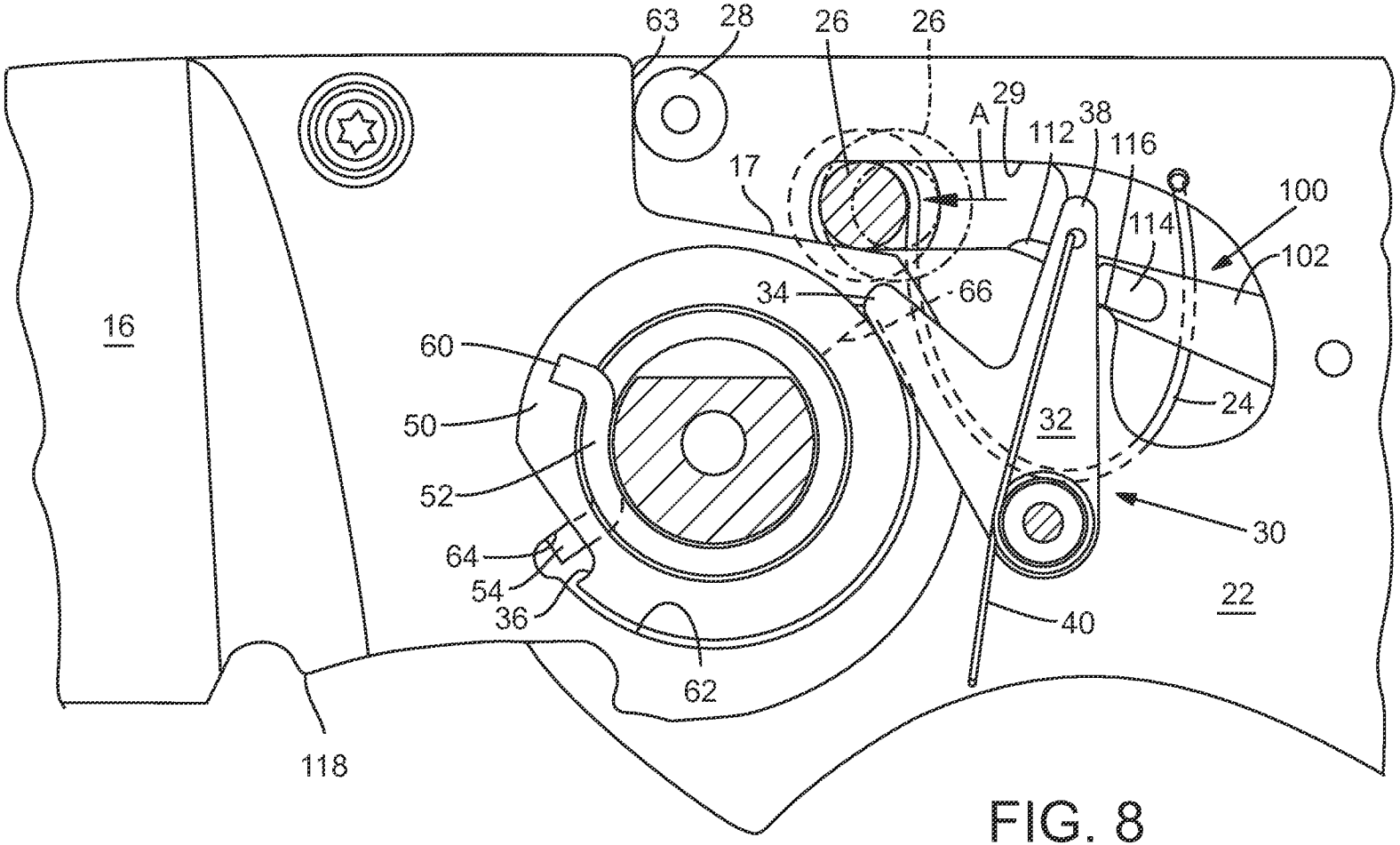

In FIG. 8, blade 16 is in the fully open position with a shoulder 63 of the blade abutting the blade stop pin 28. The blade is locked in this position by virtue of the lock bar 26 being driven forward by springs 24 in the direction of arrow A, and interacting with a ramped tang portion 17 of the blade 16. In this forward position (shown in solid lines in FIG. 8) the lock bar is thus blocking counterclockwise rotation of the blade relative to the handle and creating a 3-point triangular locking geometry defined by the lock bar, the shoulder/stop pin and the pivot axis. In this fully open position the torsion spring 52 continues to apply spring pressure to the blade in the clockwise direction.

Figure 9:
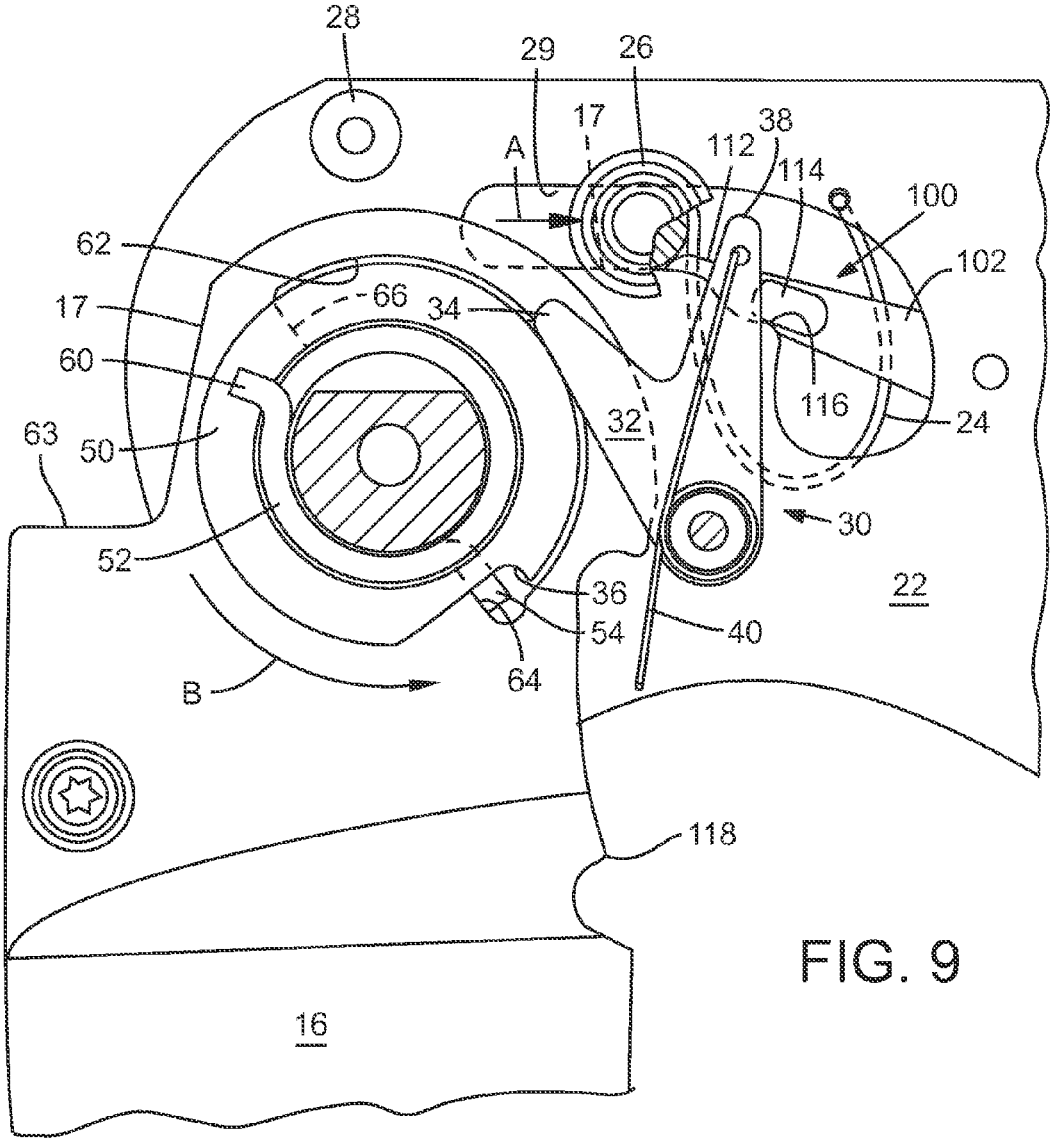
Figure 10:
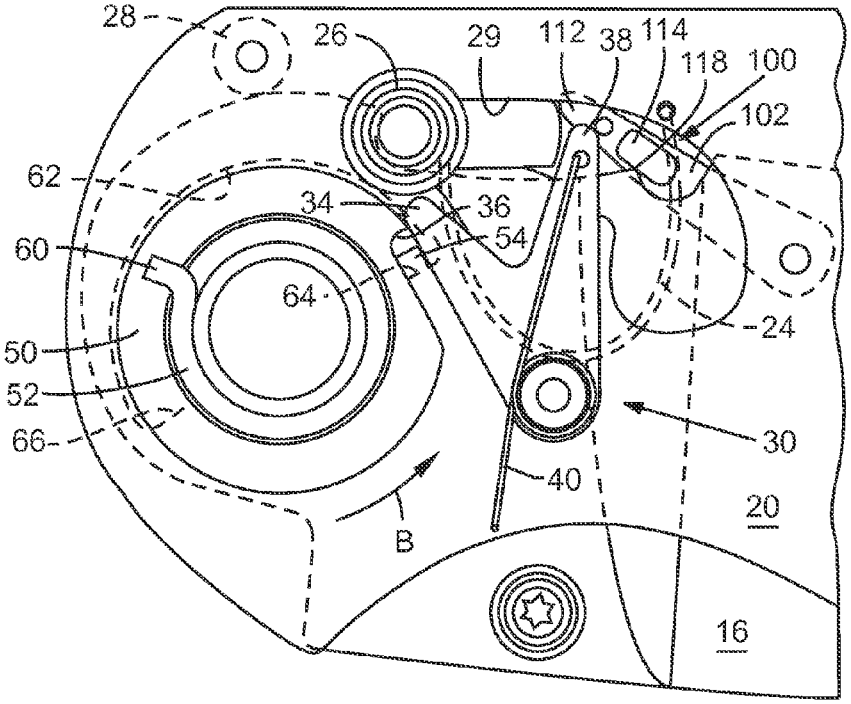
Figure 11:
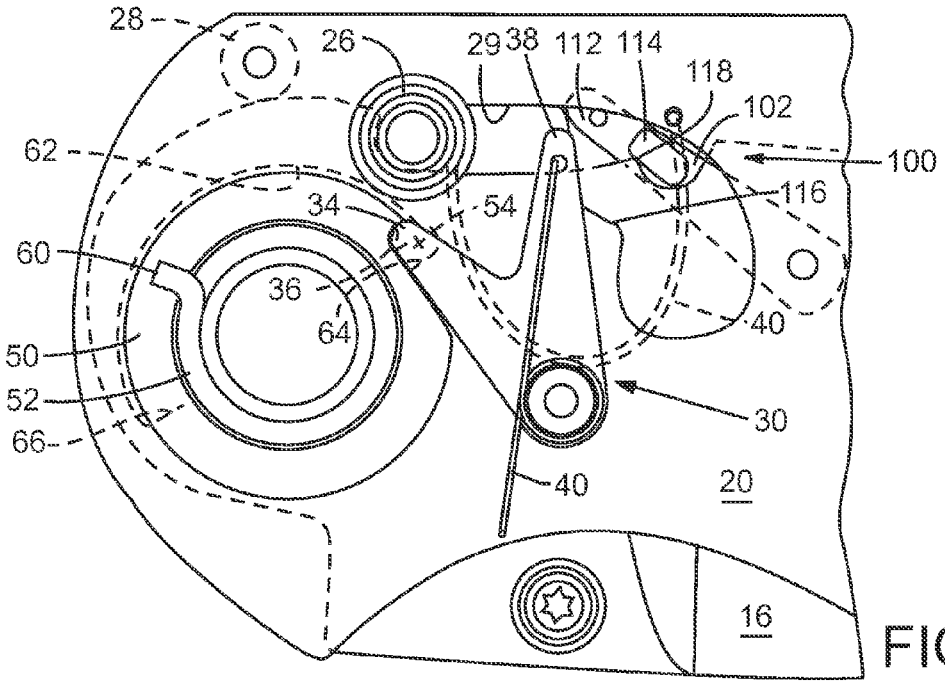

In FIG. 9 the blade 16 has been unlocked by sliding lock bar 26 in the rearward direction (arrow A, FIG. 9) so that the lock bar no longer interacts with the ramped portion 17 of the blade. With the lock bar in the unlocking position, the blade may be rotated from the open position toward the closed position as shown by arrow B. As this happens, arm 34 of actuator 32 rides over the bushing 50 until the arm is pushed into notch 36, at which point the automatic firing mechanism is again loaded and ready to be fired once again. FIGS. 10 and 11 are a continuing sequence of illustrations showing the blade 16 being moved from open to closed (arrow B, FIG. 10) after having been opened in the automatic mode. In FIG. 10 the arm 34 is on the verge of re-engaging notch 36 on bushing 50; the blade 16 is nearly in its fully closed position. As noted previously, as the blade 16 is rotated from open to closed, the spring 52 is wound by rotation of the blade. Turning once again to FIG. 1B, when the blade 16 is being rotated from open toward closed (after having been opened automatically), leg 54 of spring 52 abuts and pushes against end 64 of pocket 62. As the blade rotates, the bushing 50 also rotates and the spring is rewound. In FIG. 11 the blade has reached the completely closed position and arm 34 is pushed into notch 36 under the driving spring force of spring 40. In this position the spring 52 is fully rewound and the automatic firing mode is ready to be fired once again.

From the foregoing description of the invention and the drawings discussed so far, it will be apparent that the knife 10 has dual operational modes, manual and automatic, and that with the knife blade in the closed position the user may operate the blade opening procedure in either mode without having to actuate some kind of mode-switching device. Manual operation is a standard and well-known process by which the blade is manually manipulated to rotate it from closed to open and vice versa. Automatic opening is facilitated by the user manipulating the lock bar to slide it rearwardly, thereby causing the actuator to disengage from the notch in the bushing, allowing the bushing and blade to rotate rapidly and move from closed to open.

Figure 12A:
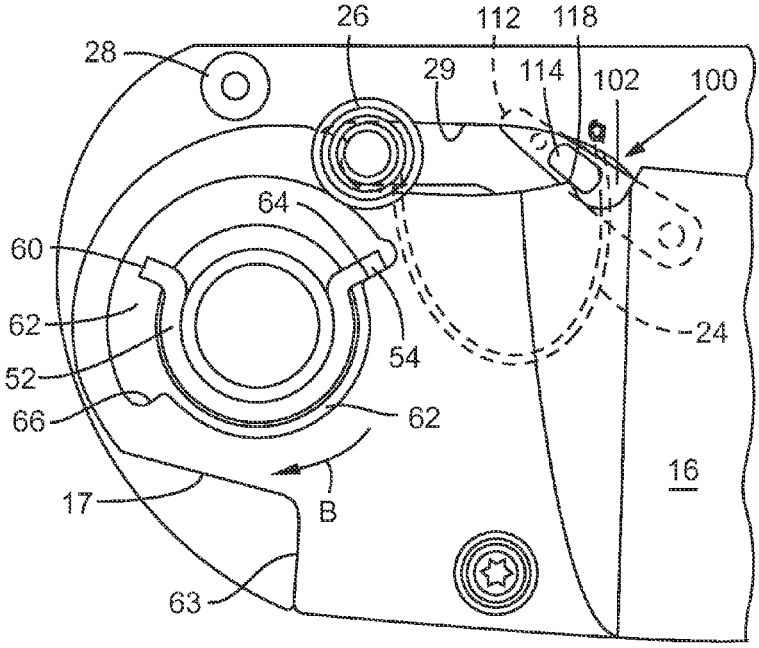
FIGS. 12A, 12B and 12C are a sequential series of illustrations showing operation of the knife in the manual mode. Specifically.
Figure 12B:
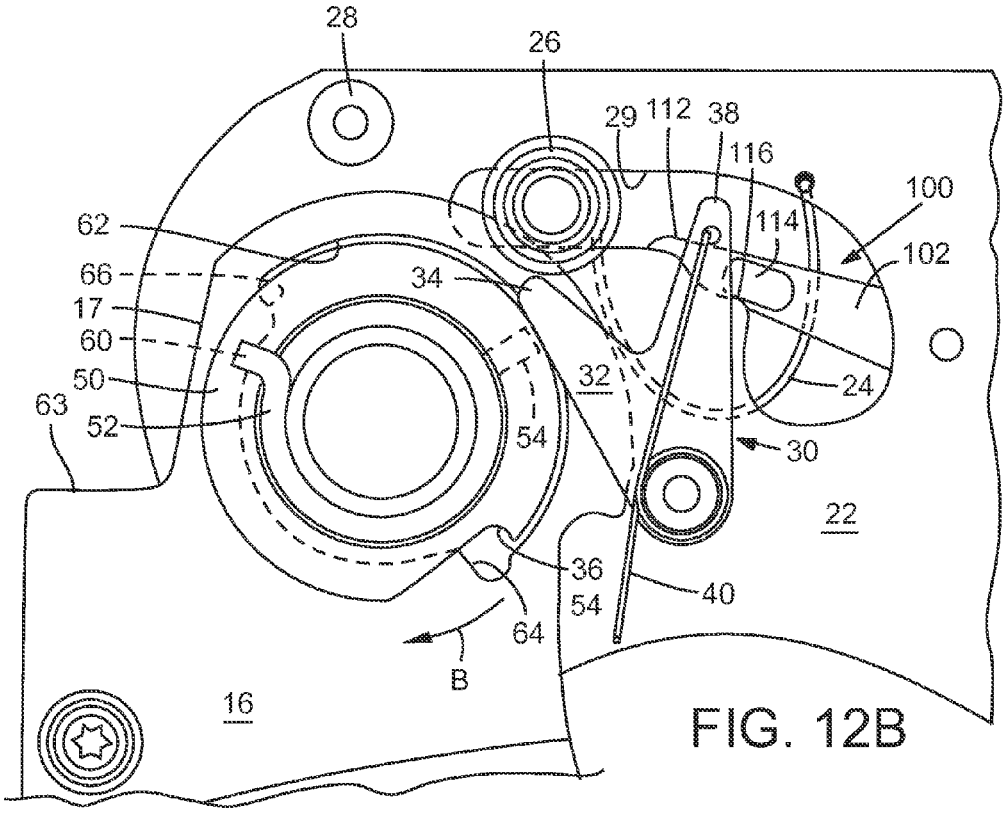
Figure 12C:
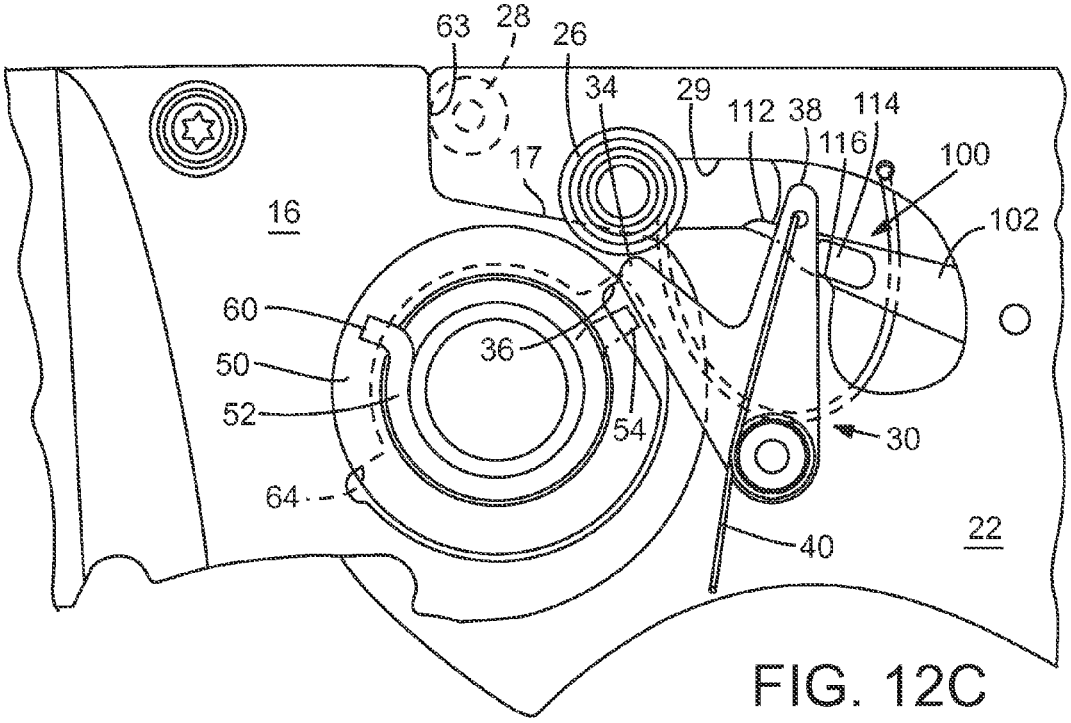

FIGS. 12A, 12B and 12C are a sequential series of illustrations showing operation of the blade 16 opening in the manual mode. The bushing 50 is locked in this series of drawings with actuator mechanism 30 as described above, but the bushing and actuator are removed from FIG. 12A to better illustrate the interaction of the torsion spring 52 with the pocket 62 in blade 16. In FIG. 12A the blade 16 is in the closed position with the bushing 50 locked. In this position, the blade 16 is free to rotate around the second spring leg 54 with no interference from the spring leg 54 or any other part of the automatic opening mechanisms. Therefore, a user may freely rotate the blade from closed to open by simply applying pressure to the blade to rotate it in the direction of arrow B, FIG. 12A.

In FIG. 12B the blade 16 is being rotated manually from closed to open and is about 90 degrees out of the closed position. As the blade rotates, the end of pocket 62 in the blade moves away from spring leg 54, which is constrained from moving, unwinding, by bushing 50, which is prevented from moving by the lockup provided by arm 34 engaging notch 36. As detailed below, when the blade 16 is being opened manually the lock bar 26 cannot be moved rearward enough to actuate actuating mechanism 30 because the forward end 112 of an elongate arm 102 is blocking movement of the lock bar and thereby preventing firing of the automatic opening mechanisms. However, as the blade 16 rotates in the clockwise direction of arrow B, lock bar 12 does move in the aft and then forward direction slightly as it rides on the blade as it rotates.

In FIG. 12C the blade 16 is in the fully open position with the shoulder 63 of the blade 16 abutting stop pin 28 and the lock bar 26 in the forward, locked position. The blade 16 is closed by moving the lock bar 26 rearwardly toward the butt of the handle (to the right in FIG. 12C) to unlock the blade, then rotating the blade counterclockwise (in FIG. 12C) until it is in the fully closed position. Again, lock bar 26 may be slid rearwardly a sufficient distance to allow the locking mechanism to be unlocked so that the blade may be moved from open to closed, but the dry fire safety mechanism described below prevents the lock bar from triggering the automatic opening mechanism.

As noted previously, the knife 10 according to the present invention further includes a "dry fire safety" mechanism. This mechanism ensures that the user cannot actuate the automatic mode of operation when the blade is open or in any intermediate position between open and closed when the blade is being moved in the manual opening mode. "Dry firing" the main torsion spring 52 without the resistance of the blade's mass can cause damage to the torsion spring, and may even cause catastrophic failure of the spring. The safety mechanism described below is thus a protective mechanism to ensure long life of knife 10.

Figure 13:
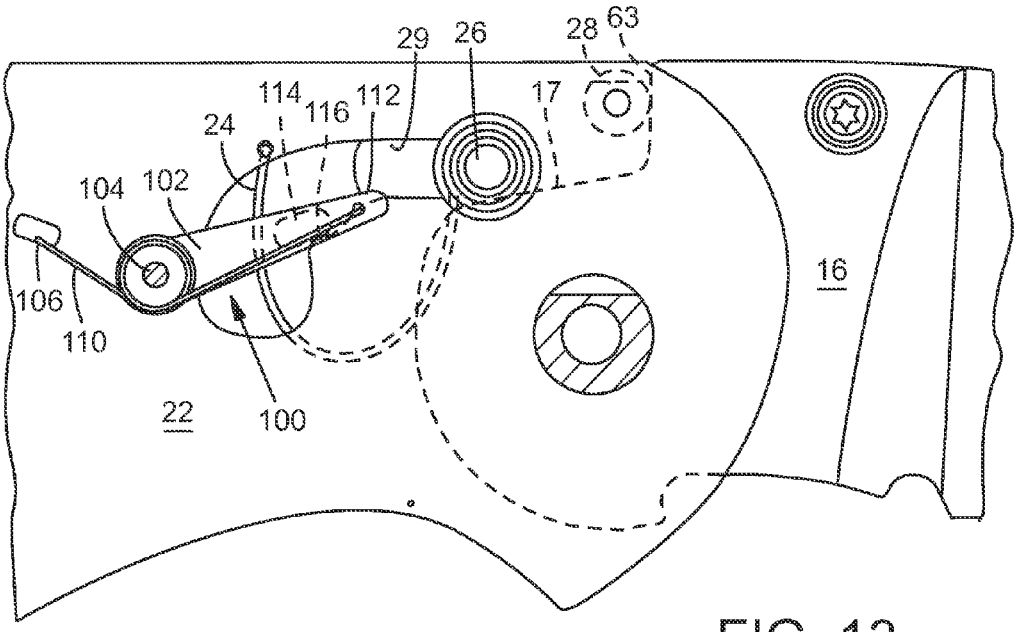

In FIG. 13 the view is of the outer side of liner 22 with sidewall 18 removed. The dry fire safety mechanism, shown generally at 100, comprises an elongate arm 102 that is pivotally attached at one end 104 thereof to liner 22. A dry fire torsion spring 110 has its first end 106 fixed to liner 22, takes a turn around the pivotal attachment of arm 102 to liner 22 at end 104, and has its second end attached to the second end 112 of arm 102. The second end 112 is oriented toward the forward end of knife 10. The first end 106 of spring 110 may be attached to liner 22 at any appropriate location. The dry fire torsion spring 110 urges second end 112 of elongate arm 102 in the clockwise direction of FIG. 13.

Figure 14:
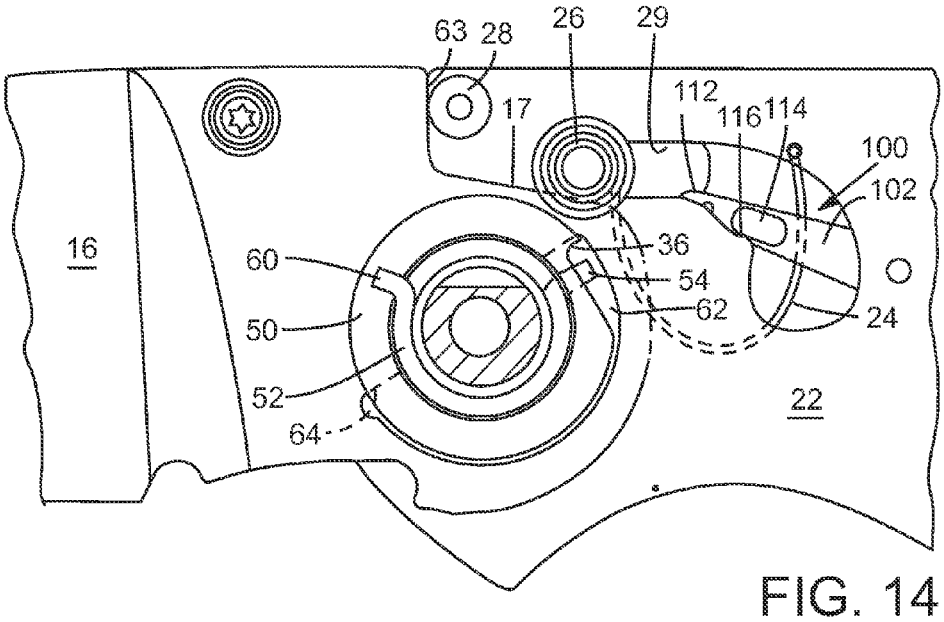

FIG. 14 is a view similar to FIG. 13 except FIG. 14 is a view taken from the opposite side of the knife from FIG. 13 (with the actuator mechanism 30 and liner 20 removed from the view of FIG. 14). A boss 114 extends from near the second end 112 of the elongate arm 102 and transverse thereto and rests on a surface 116 of the slot 29 in which the lock bar 26 moves forward and rearward. The position of the dry fire safety mechanism 100 shown in FIGS. 13 and 14 is the position when the blade 16 is open or in the process of opening (regardless of which opening modality, automatic or manual, is being used).

Figure 15A:
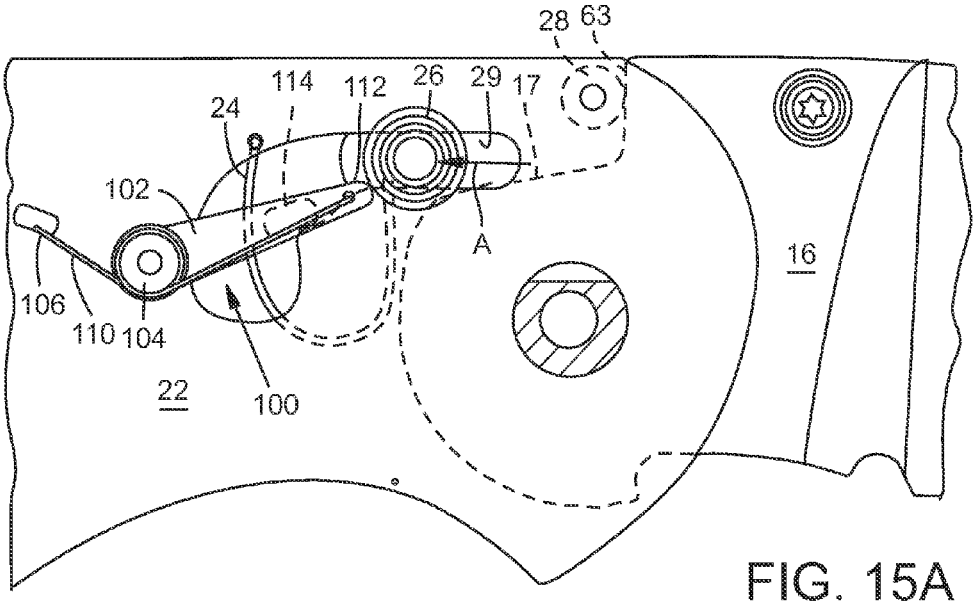
FIG. 15A is a side elevation view of the knife shown in FIG. 13 to illustrate the operation of the dry fire safety mechanism.
Figure 15B:
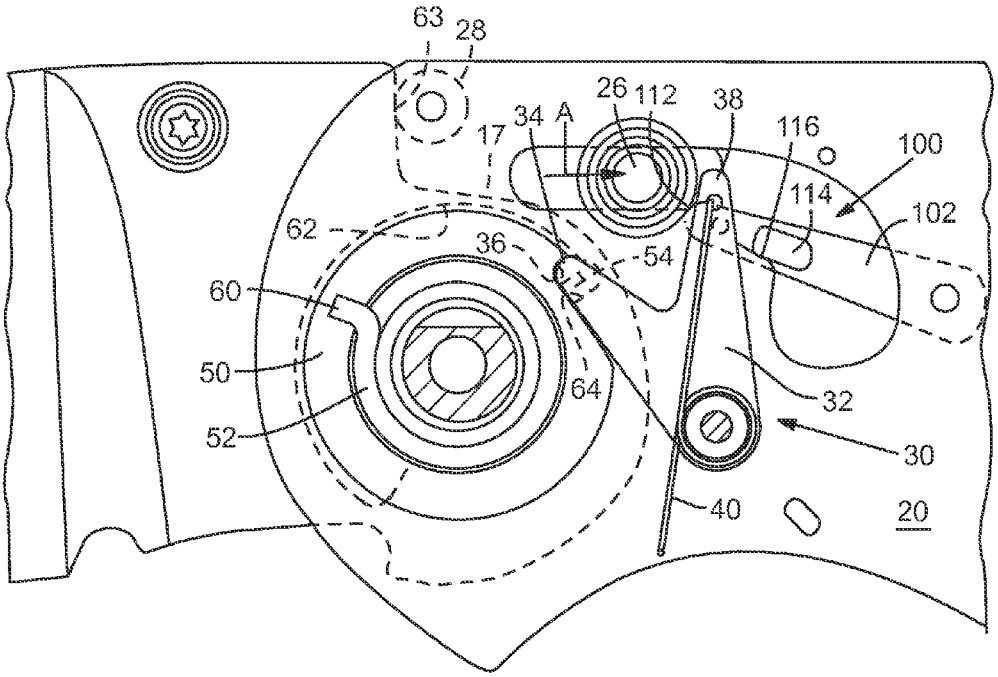
FIG. 15B is a side elevation view identical to that shown in FIG. 15A but showing the opposite side of the knife.

FIGS. 15A and 15B above illustrate how the dry fire safety mechanism 100 operates. Specifically, as the lock bar 26 is slid rearwardly (i.e., to the left in FIG. 15A and to the right in FIG. 15B—arrows A) the lock bar 26 bumps into, abuts the second end 112 of the elongate arm 102 and the arm thereby prevents the lock bar from being moved rearwardly enough that the lock bar would cause the actuator 32 from being disengaged from the notch 36 in bushing 50. Even more specifically, as the lock bar 26 is moved in the direction of arrow A, it presses against arm 38 of V-shaped actuator 32, pushing the arm in the same direction as arrow A. However the arm 38 is prevented from moving because lock bar 26 impinges on the forward end 112 of arm 102. Therefore, if the blade is in any position other than the fully closed position, the automatic opening mechanism cannot be fired because the lock bar cannot be moved to the position that would cause firing.

Figure 16A:
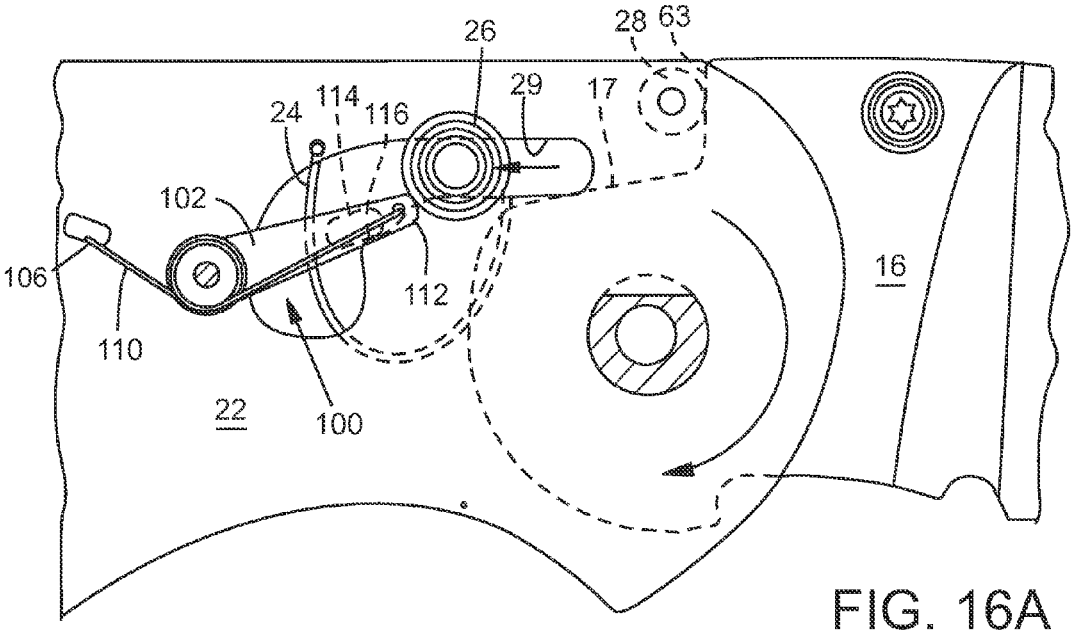
FIGS. 16A and 16B are side elevation views of the knife, similar to FIGS. 15A and 15B except showing the dry fire safety mechanism when the blade is in the open position (FIG. 16A) and in the closed position (FIG. 16B)
Figure 16B:
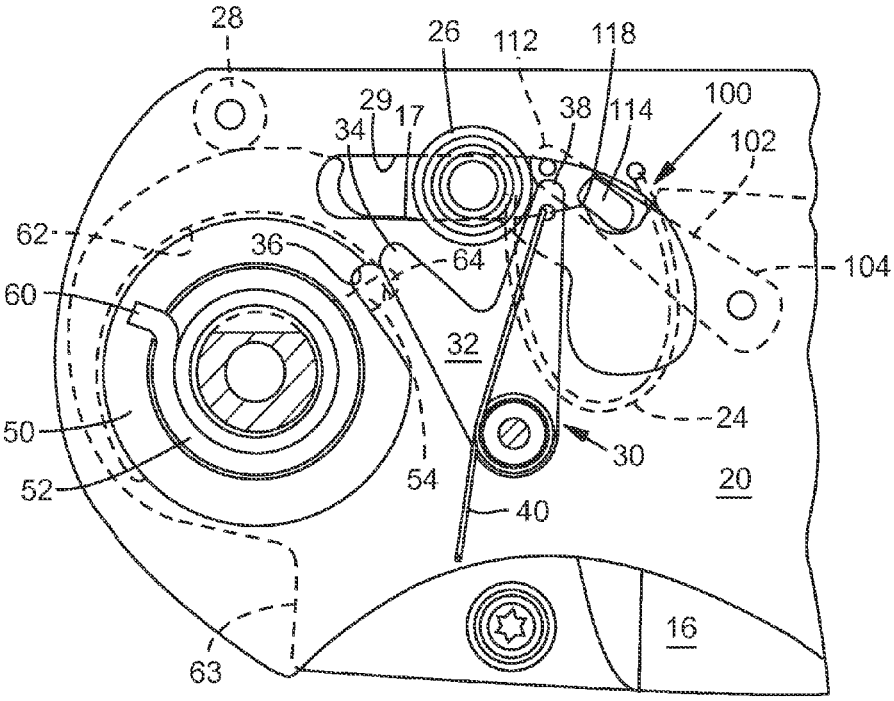

FIGS. 16A and 16B are opposite side views of the dry fire safety mechanism 100; in FIG. 16A the blade is in the open position and in FIG. 16B the blade is in the closed position. With reference to FIG. 16A, when blade 16 is in the open position the lock bar 26 may be slid rearwardly sufficiently to unlock the blade to allow it to be rotated from open to closed, but as detailed above the forward end 112 of arm 102 prevents the automatic mechanism from firing. Turning to FIG. 16B, with the blade in the closed position a shoulder 118 formed on blade 16 pushes on boss 114 of elongate arm 102, driving the elongate arm upwardly (in the view of FIG. 16B) so that the forward, second end 112 of the arm 102 is out of the way of lock bar 26. With the arm 102 lifted upwardly as shown in FIG. 16B, the lock bar may be slid rearwardly (i.e. to the right in FIG. 16B), thereby pushing on the second arm 38 of V-shaped actuator 32 and causing the first arm 34 to disengage from notch 36, thereby firing the automatic opening mechanism as detailed above.

While the present invention has been described in terms of a preferred embodiment, it will be appreciated by one of ordinary skill that the spirit and scope of the invention is not limited to those embodiments, but extend to the various modifications and equivalents as defined in the appended claims.

The invention claimed is:

1. A folding knife, comprising, a handle with a first end and a second end with a longitudinal axis running therebetween and defined by first and second handle halves held in a spaced apart relationship with a blade groove formed therebetween;

a pivot shaft between the first and second handle halves;

a blade pivotally connected between the handle halves with the pivot shaft adjacent to the blade groove, and movable between an open position and a closed position, wherein the blade groove receives the blade in the closed position;

a bushing rotatably disposed around the pivot shaft;

a spring disposed around the pivot shaft, the spring retained in the bushing, the spring having a first leg fixed to the first handle half and a second leg extending through a slot in the bushing and into an arcuate pocket in the blade;

a lock bar that extends transverse to the longitudinal axis of the handle, the lock bar having opposite ends that movably extend in a first slot in the first handle half and a second slot in the second handle half, the lock bar movable by a user between a third position and a fourth position; and an actuator pivotally connected to the first handle half, the actuator having a first portion and a second portion, the actuator pivotal between a fifth position in which the first portion of the actuator engages the bushing to prevent rotation thereof, and a sixth position in which the first portion of the actuator disengages from the bushing to allow rotation thereof, and the second portion of the actuator configured for interacting with the lock bar;

and wherein when the lock bar is moved from the third position to the fourth position the lock bar engages the second portion of the actuator to thereby move the first portion of the actuator from the fifth position to the sixth position.

2. The folding knife according to claim 1 wherein when the first portion of the actuator is moved from the fifth position to the sixth position the spring drives the blade from the closed position to the open position.

3. The folding knife according to claim 2 wherein when the blade is in the open position, the lock bar interacts with a tang portion of the blade to lock the blade in the open position.

4. The folding knife according to claim 1 including a notch on the bushing, wherein the first portion of the actuator engages the notch when the actuator is in the fifth position.

5. The folding knife according to claim 1 wherein each of the first handle half is comprised of a first outer side wall and a first liner defining the first slot, and the second handle half is comprised of a second outer side wall and a second liner defining the second slot, the pivot shaft is between the first and second liners, the first leg of the spring is fixed to the first liner, the opposite ends of the lock bar movably extending in the first slot in the first liner and the second slot in the second liner, the actuator pivotally connected to the first liner.

6. The folding knife according to claim 5 including a safety coupled to the second liner.

7. The folding knife according to claim 6 in which the safety includes a safety arm pivotally attached to the second liner for movement between a safety arm seventh position in which the safety arm prevents the lock bar from moving to the fourth position, and a safety arm eighth position in which the lock bar may be moved from the third position to the fourth position.

8. The folding knife according to claim 7, wherein the first liner includes the first slot, and wherein the safety arm includes a boss that extends into the first slot in the first liner in which the lock bar moves, wherein when the blade is in the closed position, the blade engages the boss to thereby move the safety arm to the eighth position.

9. The folding knife according to claim 7 wherein when the blade is in any position other than the closed position, the lock bar is prevented, by the safety arm in the seventh position, from moving to the fourth position and contacting the first portion of the actuator, thereby preventing the actuator from being moved to the sixth position by the lock bar.

10. The folding knife according to claim 1 wherein the actuator is a V-shaped member having a first arm and a second arm, wherein the first arm is the first portion of the actuator, and wherein the second arm is the second portion of the actuator.

11. The folding knife according to claim 10 including a spring attached to the second arm and coupled to the first handle half that urges the V-shaped member into the fifth position.

12. The folding knife according to claim 1 wherein when the blade is in the closed position, the blade may be moved to the open position either automatically by a user moving the lock bar between the third position and the fourth position which disengages the actuator from the bushing to allow rotation thereof by the spring disposed around the pivot shaft, or manually.

* * * * *